United States Patent [19]

Castel

[11] 4,331,207

[45] May 25, 1982

[54] DEVICE FOR REVERSING THE DIRECTION OF FLOW OF A FLUID AT THE LEVEL OF A DRILL BIT

[75] Inventor: Yvon Castel, Pau, France

[73] Assignee: Institut Francais du Petrole, Rueil-Malmaison, France

[21] Appl. No.: 70,388

[22] Filed: Aug. 28, 1979

[30] Foreign Application Priority Data

Aug. 28, 1978 [FR] France ..... 78 25111

[51] Int. Cl.[3] ..... E21B 21/00

[52] U.S. Cl. ..... 175/317; 175/243; 175/322

[58] Field of Search ..... 175/243, 317, 215, 217, 175/322

[56] References Cited

U.S. PATENT DOCUMENTS

| | | | |
|---|---|---|---|
| 1,619,328 | 3/1927 | Benckenstein | 175/317 X |
| 2,805,043 | 9/1957 | Williams, Jr. | 175/317 |
| 3,365,007 | 1/1968 | Skipper | 175/243 X |
| 3,410,355 | 11/1968 | Garrett | 175/317 |
| 3,743,035 | 7/1973 | Tiraspolsky | 175/317 |

*Primary Examiner*—William F. Pate, III

*Attorney, Agent, or Firm*—Millen & White

[57] ABSTRACT

This device, positioned above the drill bit, comprises a body provided with an axial bore communicating with the drill string and distribution means, controlling the direction of flow of the flushing fluid, slidably mounted in said bore and having two positions. This distribution means can be shifted from a first to a second position and vice-versa by a succession of fluid supply periods separated by periods of interruption of the fluid supply.

7 Claims, 15 Drawing Figures

DEVICE FOR REVERSING THE DIRECTION OF FLOW OF A FLUID AT THE LEVEL OF A DRILL BIT

BACKGROUND OF THE INVENTION

The present invention relates to a device for reversing the direction of flow of a flushing fluid at the level of a drill bit, such as, for example, but not exclusively, a drilling tool creating a vacuum, or negative pressure, at the level of the bit working face during ground drilling operation.

Such a drill tool, described in French Patent Specification 1,567,862, comprises a tool body, at least one ground cutting area provided on said body and delimiting the bit working face, and means for creating in an internal recess of said tool a negative pressure as compared to the pressure prevailing at the level of this working face.

The working face is connected to the zone of negative pressure through at least one duct for lifting the ground cuttings, while a duct for discharging the drilling or flushing fluid passes through the negative pressure zone and opens into the annular space between the drill string and the wall of the drilled borehole through at least one orifice opening outside the tool working face, the flow rate of drilling fluid between the orifice of the discharge duct and the tool working face being limited.

There is thus obtained, under normal operating conditions, a centripetal flushing of the tool working face, i.e., a flow of flushing fluid directed from the borehole wall towards the borehole axis.

It has been however experimentally ascertained that it may sometimes be necessary to temporarily provide a centrifugal flow of flushing fluid, i.e. a flow directed from the borehole axis towards the borehole wall.

This is for example required when drilling through a ground layer containing a fluid such as hydrocarbons at a higher pressure than that prevailing at the level of the bit working face or also when a leakage appears in the fluid flow through the geological formations.

In known devices, such as those described in U.S. Pat. No. 2,805,043 and French Pat. No. 2,071,262, displacement of a movable element uncovers apertures provided in the wall of the drill string, so that the flow of drilling fluid is partly or fully diverted through these apertures. Such devices make it possible to reduce, or even discontinue flushing of the drill bit, but do not permit reversal of the direction of flow of this drilling fluid at the level of the drill bit.

Means for reversing the direction of flow of the drilling fluid are already known. An embodiment of such means is illustrated in FIG. 3 of the Certificate of Addition 2,092,646 to French Patent Specification No. 1,567,862. Such means generally makes use of an obturator such as a ball introduced into the drill string to close a first orifice and thus produce, under the action of the drilling fluid, the displacement of a movable member, which uncovers a second orifice through which the drilling fluid is discharged to flush the drill bit with a reverse direction of flow.

Whenever the initial direction of flow of the drilling fluid must be restored, it is necessary to remove the obturator by means of a suitable fishing tool, or by raising the whole drill column to the surface.

Such operations are in any event time-consuming.

The device of the present invention makes it possible to rapidly reverse the direction of flow of the drilling fluid, so as to shift from a centrifugal irrigation to a centripetal irrigation of the tool and vice-versa, whenever required during the drilling operation.

BRIEF DESCRIPTION OF THE DRAWINGS

The invention will be more readily understood and all its advantages made apparent from the following description illustrated by the accompanying drawings wherein.

DETAILED DISCUSSION

Figure 1A:
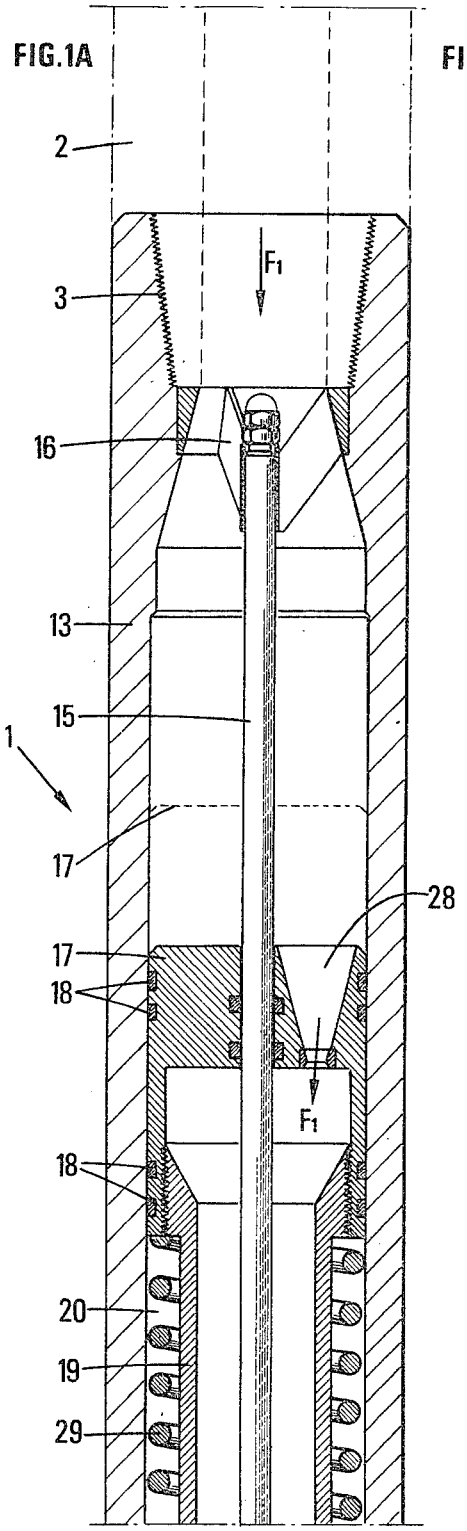
FIGS. 1A to 1D are cross-sectional views of a device according to the invention adapted to a ground drilling tool.
Figure 1B:
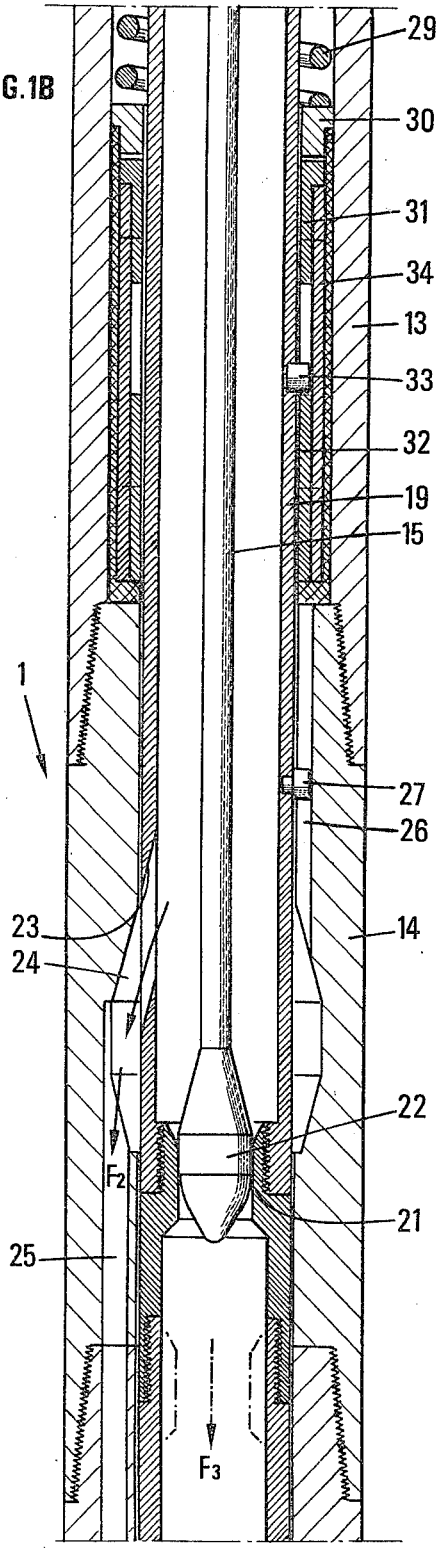

FIGS. 1A to 1D diagrammatically show successive cross-sections of the device according to the invention designated as a whole by reference 1.

At its upper part (FIG. 1A), the device 1 is secured to the lower end of a drill string 2 by any suitable means, such as a threading 3.

At its lower end (FIG. 1D), the reversing device 1 is extended by any suitable device 4 operative to create a negative pressure at the level of the tool working face during drilling of the ground, as above indicated.

At the lower end of the device 4 is secured a drill bit provided with an axial duct 6.

The drill bit forms no part of the invention and has therefore not been illustrated. Only its upper part secured by a threading to the device 4 is shown in FIG. 1D.

The device 4 forming no part of the invention, has been diagrammatically shown as a single element, but this device may obviously consist of several parts as may be required.

Briefly stated, the device 4 comprises an axial duct 7 of the Venturi type in direct communication with the central bore 6 of the drill bit. At the inlet of the Venturi, a nozzle 8 creates a fluid jet in a direction opposite to the drilling direction. Cooperation of Venturi 7 and nozzle 8 creates a negative pressure, applied, through duct 6, to the working face of the tool which is fed with drilling fluid through the annular space delimited between the device 4 and the borehole wall. At the upper part of the device 4 a separator 9 provides a passage for the part of the drilling fluid flowing out from the central part of the Venturi 7. This part of the fluid flow is recycled through orifice 38 and duct 10 (dotted line in FIG. 1C) and flushes again the tool 5, as above indicated.

The remaining part of the fluid, loaded with drill cuttings, is discharged to the surface through a duct 11, opening in the annular space at a distance above the opening of duct 10.

The nozzle 8 is fed with fluid through an annular space 12, provided in the body of the device 4.

The device according to the invention comprises a tubular body formed of several parts for constructional requirements. Along the axis of the body 13-14 is suspended a rod 15 connected to the body by supporting arms 16.

A piston 17 is slidably mounted in the bore of this body, the piston being provided with sealing rings 18 and having a central bore sealingly traversed by the rod 15. The piston 17 is extended by a tubular element 19 whose inner diameter is greater than the diameter of the rod 15 and whose outer diameter delimits an annular space 20 over a portion of the bore of the body 13.

The internal bore of the tubular element 19 has a constricted portion 21 of reduced diameter and the free end of rod 15 is equipped with an obturator 22 for said portion 21.

The obturator 22 consists, for example, of a cylindrical member which can be inserted into the portion 21. Thus, the constricted portion 21 and the obturator 22 form means for obturating the tubular element 19.

Above the level of said obturating means, tubular element 19 is provided with at least one orifice 23 and an annular recess 24, provided in the body 14, directly communicates with at least one duct 25 which opens at its lower end, into the annular space 12. The tubular element 19 is adapted to rotate together with the body 14, for example, by means of a locking assembly formed of groove 26 and pin 27, one of which is secured to the tubular element 19 and the other to the body 14. Alternatively this locking assembly can be substituted with an assembly formed of interlocking corrugations.

The piston head 17 is traversed by at least one calibrated duct 28 through which the internal bore of body member 13 communicates with the tubular element 19.

In the annular space 20 is housed a mechanism limiting the axial displacements of tubular element 19 relative to the body 13-14, as well as a compensating spring 29 bearing on the piston 17, at one end, and on a shoulder 30 integral with the body 13, at the other end.

The mechanism for limiting the axial displacements of tubular element 19 comprises a guide finger 33 carried by the tubular element 19 and two profiled rings 31 and 32 each having a stationary axial position; relative to the body 14 about which they are freely rotatable. These rings are interconnected, for example, by means of a sleeve 34 to which they are suitably secured.

Figure 2:
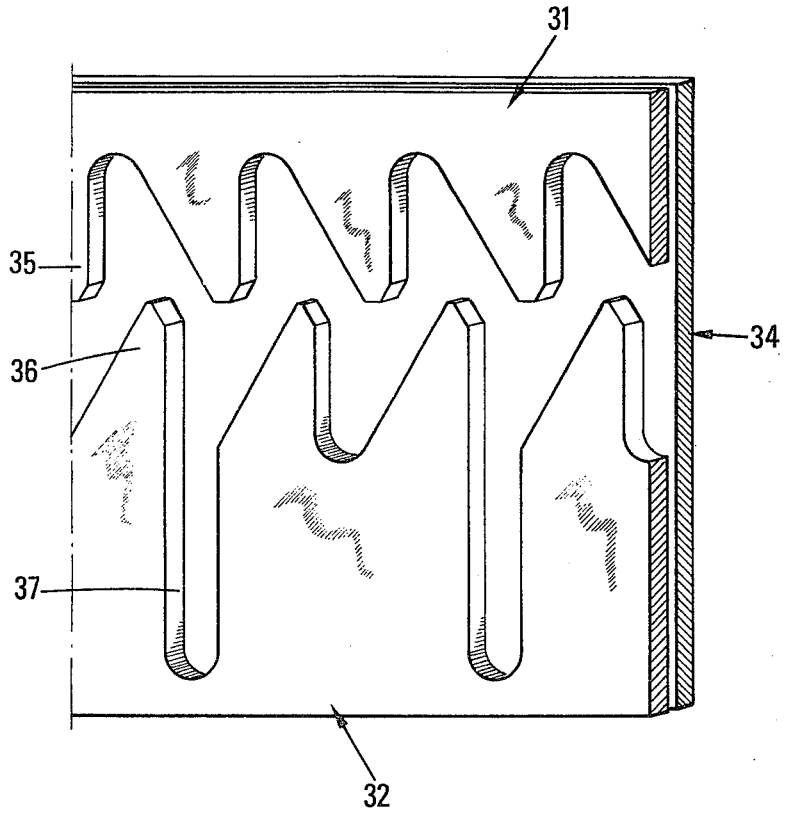
FIG. 2 shows the profile of the mechanism limiting the axial displacements of the tubular element.

FIG. 2 shows the outline of these rings. The upper ring 31 has a saw-toothed profile with one wall parallel to the ring axis and another wall inclined to the ring axis. The teeth 35 have the same height and are even in number.

Although only four teeth have been shown, this number is by no way limitative. The lower ring 32 has the same number of identical teeth 36 but they are grouped in pairs separated by grooves 37 of the same height and parallel to the ring axis.

The inclined walls of the teeth 36 are located on the opposite side from the inclined walls of the teeth 35.

The teeth of the two rings are staggered, the profiles of these teeth co-operating to form a cam or guide path so that the guide finger 33 can be displaced in the remaining free space.

In the application illustrated by the drawings, the separator 9 of the element 4 is secured to the free end of tubular element 19 which is also provided with an orifice 38 through which fluid can flow to duct 10 when element 19 is appropriately positioned, as will be clear from the following description of the operation of the assembly.

When the fluid circulation is discontinued, the spring 29 holds its uppermost piston 17 in the position shown in dashed line by the FIG. 1A. Correlatively the guide finger 33 is in the upper position shown in FIG. 3A, being maintained between two teeth of ring 31.

Figure 1C:
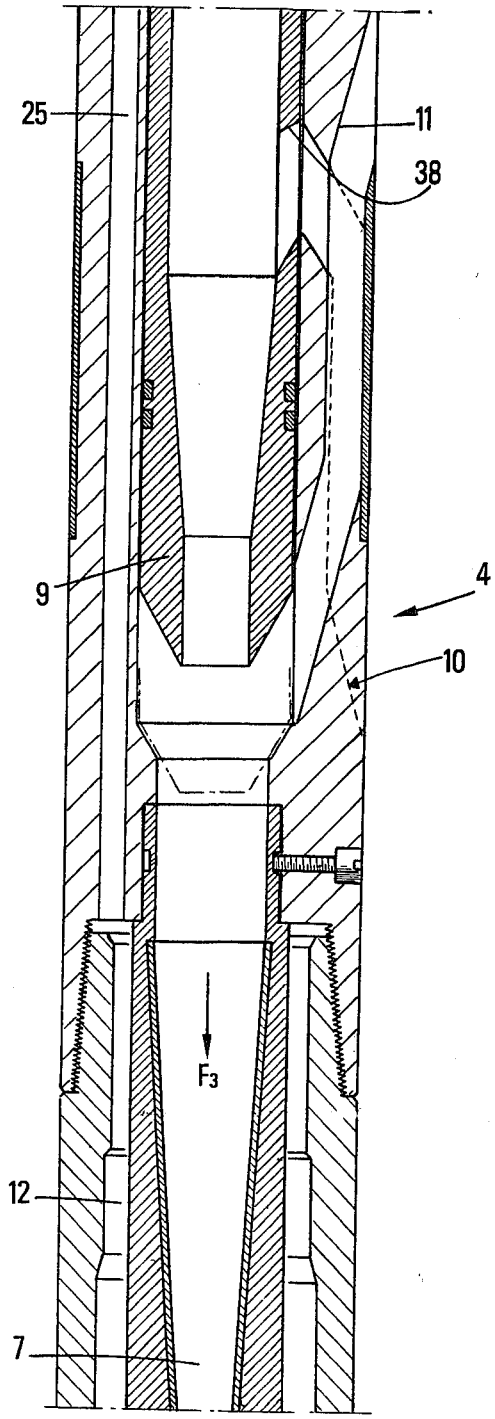
Figure 1D:
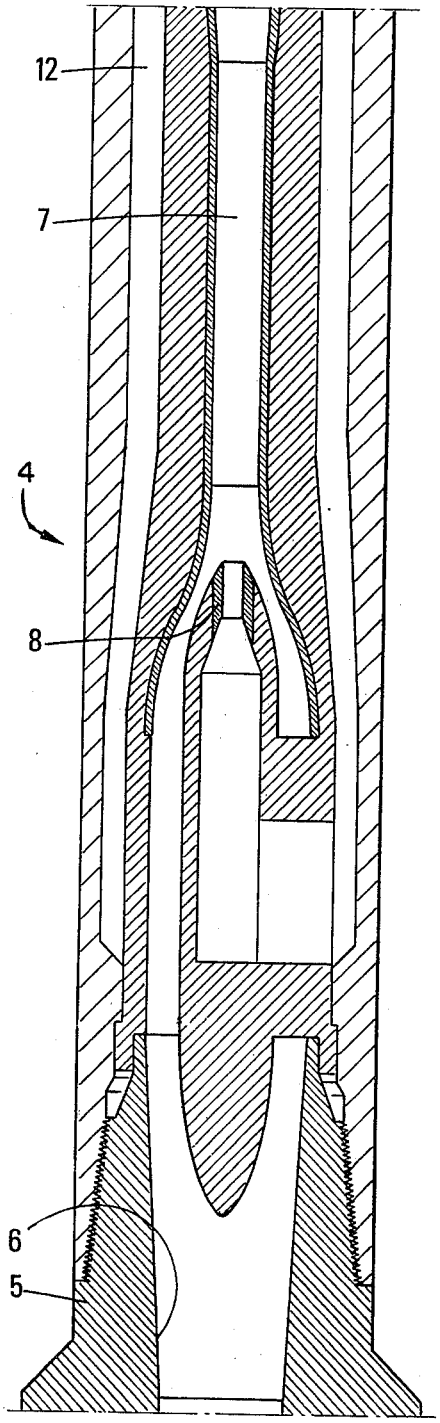
Figure 3A:
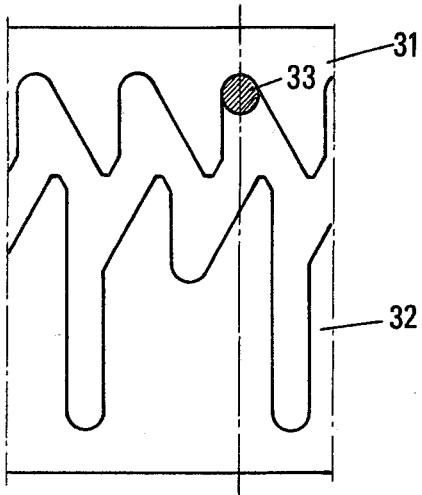
FIGS. 3A to 3J illustrate the operation of the device according to the invention.

The assembly is then fed with pressurized drilling fluid which flows in the direction of the arrows $F_1$ (FIG. 1A). The pressure drop created by the calibrated duct 28 results in a pressure difference $\Delta P$ between the sides of the piston head 17 which is downwardly displaced from its position of FIG. 1 A against the action of spring 29. The guide finger 33 first reaches the position shown in FIG. 3B where it contacts the inclined side wall of the tooth of ring 32. Upon further downward displacement, the finger 33 drives in rotation over $R_1$ the rings 31 and 32 and the guide finger reaches its position of FIG. 3C. During its displacement, the piston 17 displaces the tubular element 19 so that the orifice 23 uncovers the annular space 24 while the constricted portion 21 is positioned at the level of the obturator 22 and the orifice 38 uncovers the duct 10 (FIG. 1C). The device is then by the position shown in solid lines in FIGS. 1A to 1D. The drilling fluid flows in the direction of the arrows $F_1$ and $F_2$ through the calibrated aperture 28, through the bore of the tubular element 19, then through the orifice 23 and the annular space 24, into the duct 25 which then supplies fluid to the element 4 through the annular space 12. The fluid jet escaping from the nozzle 8 creates a negative pressure in the central duct 6 of the tool, thus causing upward flow of the drilling fluid loaded with drill cuttings through this duct.

The fraction of drilling fluid loaded with drill cuttings, after passage through the Venturi, flows upwardly to the surface through the duct 11 (FIG. 1C), while the fluid fraction flushing the bit flows through the separator 9, then through orifice 38 and duct 10, before achieving a centripetal flushing of the drill bit.

The pressure in the drill string at the surface then has a first value $P_1$. Should it be wished to reverse the flow direction of the flushing fluid at the level of the drill bit, then the operation must be as follows:

The drilling fluid supply is discontinued and the piston 17 then moves upwardly under the action of the spring 29.

Figure 3D:
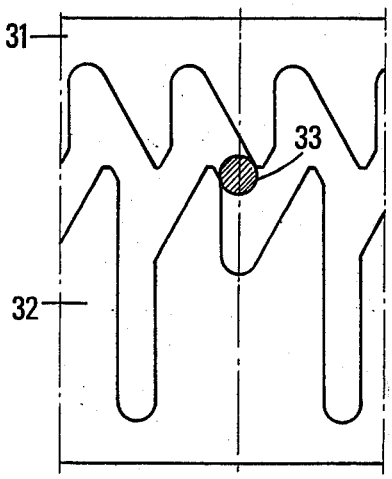
Figure 3B:
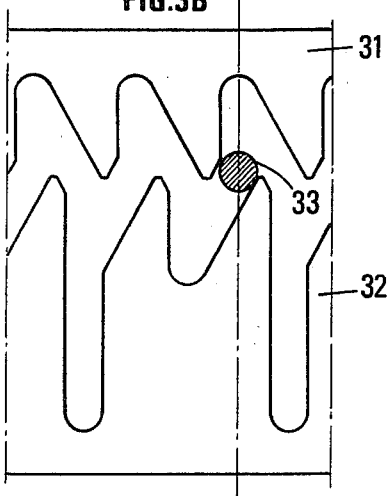
Figure 3E:
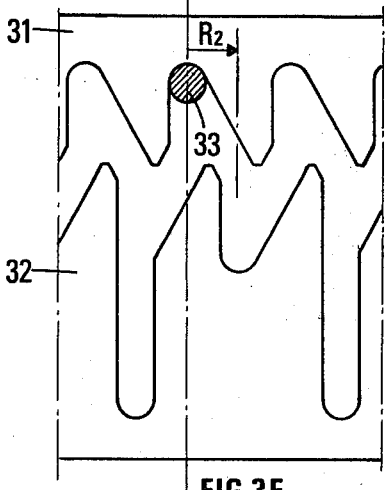
Figure 3C:
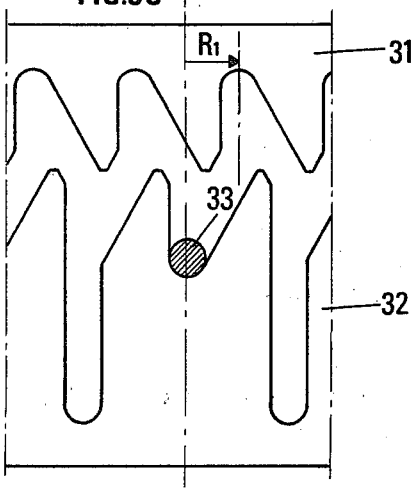

During this axial displacement, the guide finger 33, first reaches the inclined side wall of a tooth of the ring 31 (FIG. 3D). Upon further displacement it causes a rotation $R_2$ of the rings 31 and 32. The guide finger 33 reaches its uppermost position (FIG. 3E) and the piston 17 is back in its initial position. By restoring the drilling fluid supply the piston 17 is again moved downwardly from its position shown in the drawing.

Figure 3F:
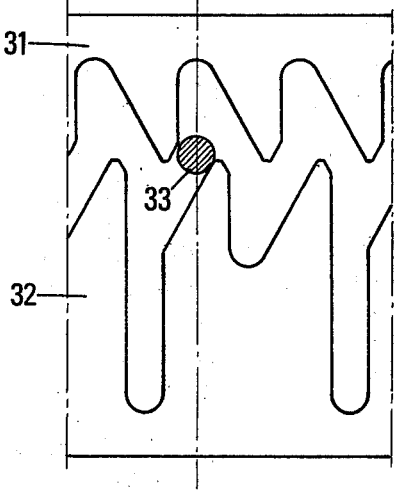
Figure 3G:
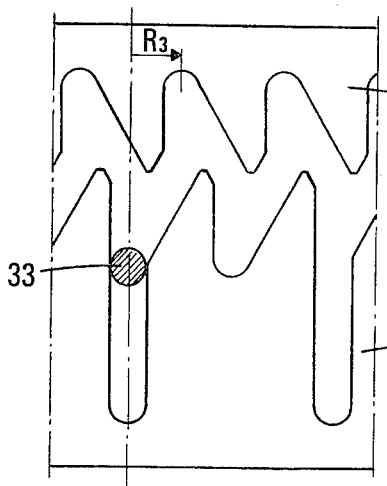
Figure 3I:
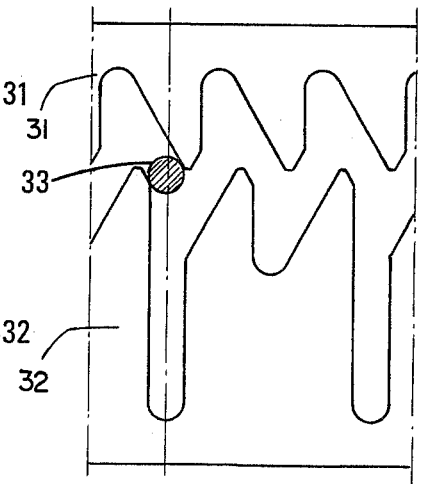
Figure 3H:
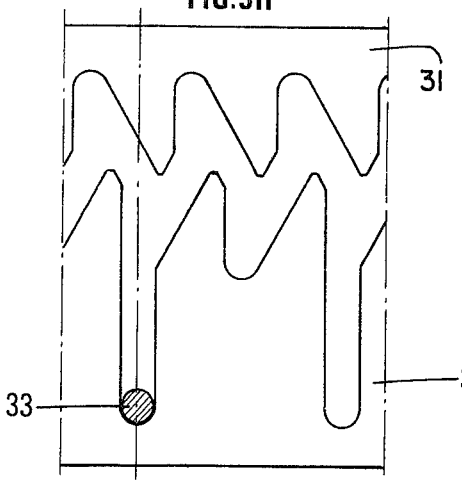

The guide finger 33, when reaching its position of FIG. 3F causes a rotation $R_3$ of the rings 31 and 32 (FIG. 3G) before reaching the bottom of groove 37 (FIG. 3H).

In this position, the tubular element 19 fully covers the annular space 24 as well as the inlet orifices of the ducts 10 and 11 (position shown in broken line in FIG. 1C). Simultaneously the portion 21 of reduced bore diameter is in the position shown in broken line in FIG. 1B, so that the obturator 22 is fully disengaged from this constricted portion 21.

After leaving the calibrated duct 28, the drilling fluid flows through the tubular element 19 as indicated by the arrow in broken line $F_3$ and directly feeds the central duct 6 of the bit through the duct 7 of the element 4, thus providing for a centrifugal flushing of the drill bit. The fluid loaded with drill cuttings rises to the surface through the annular space delimited between the wall of the borehole and the drill-string. Under these operating conditions the pressure in the drill-string has a second value $P_2$ different from $P_1$.

Figure 3J:
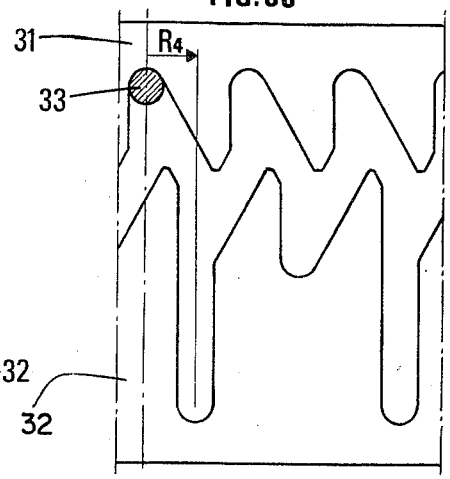

The flow of drilling fluid being again discontinued, the piston 17 is urged back upwardly by the spring 29, the guide finger 33 first reaching the position shown in FIG. 3I and then causing a further rotation of rings 33 and 34 (FIG. 3J which is equivalent to FIG. 3A).

The device is then back to its initial position wherefrom, by a succession of periods of fluid supply followed by an interruption of this fluid supply, it is possible to again reverse the direction of flow of the drilling fluid at the level of the bit. Thus the piston 17, the tubular element 19 and the obturating means 21-22 form a distribution assembly, displaceable in the central bore of the body under the action of the flow of pressurized fluid, and having a first position wherein the fluid is discharged exclusively through the central bore to provide a first operating mode of the tool, and a second position wherein the fluid is discharged exclusively through the duct 25 to provide a second operating mode of the tool, this distribution assembly being capable of alternate shift from one position to the other as a result of the successive effect of the fluid supply and the interruption thereof.

In the foregoing the device according to the invention has been described by way of non-limitative example, in association with means 4 for creating a negative pressure. However, it is also possible to use this device for directly feeding the central bore of a conventional drill bit through the bore of the tubular element 19 and providing a centrifugal flushing of the bit working face, or also for feeding the bit from the annular space surrounding this bit, duct 25 opening on the external wall of body member 14, so that this duct communicates with the annular space delimited between the drillstring and wall the of the borehole.

Other changes may be made in the device without departing from the scope of the present invention. For example the rings limiting the path or guiding cam of the finger 33 may be stationary relative to the body of the device, this finger then driving the tubular element 19 in rotation. The means for obturating the bore of the tubular element may also be formed by the cooperation of a flap valve and a valve seat, one of them being integral with the rod 15 and the other with the element 19.

What is claimed is:

1. In a drilling device comprising a drill string, a drill bit having a central bore, and a source of pressurized fluid for feeding and irrigating the drill bit and flushing the bore hole, the improvement which comprises:

a distribution assembly for alternately effecting centripetal and centrifugal irrigation of the drill bit by the pressurized fluid, comprising:

a tubular body secured between the drill string and the drill bit, said tubular body having an axial bore communicating at one end with the source of pressurized fluid and at the other end with the central bore of the drill bit, a first duct in the wall of the tubular body and having an inlet opening into the upper portion of the axial bore thereof, and a second duct in the wall of the tubular body and having an inlet opening into the lower portion of the axial bore thereof and an outlet communicating with the exterior of the tubular body;

tubular distribution means axially slidably downwardly displaceable within said axial bore alternately between a first and second position when acted upon by the flow of pressurized fluid, and axially upwardly slidably displaceable to a third rest position within the bore by resilient means when not acted upon by pressurized fluid resulting from an interruption of the flow of pressurized fluid, said tubular distribution means having a port in an upper portion of the wall thereof, said port being aligned with the inlet of said first duct in said first position, and the inlets of said first and second ducts being closed to fluid flow in said second position;

obturation means permanently disposed, with respect to said tubular body, said obturation means being a solid member located in said axial bore and adapted to controllably close a lower portion of said tubular distribution means below said port to the downward flow of pressurized fluid in response to a reciprocable sliding movement of said tubular distribution means in a first direction whereby said obturation means is in a respective first position, and to open said lower portion to fluid flow in response to a reciprocable sliding movement of said tubular distribution means in a second direction whereby said obturation means is in a respective second position; and position control means cooperating with said tubular distribution means and actuated in response to axial displacement thereof, said position control means being adapted to direct the downward displacement of the tubular distribution means alternately to said first position or to said second position;

whereby successive interruptions and resumptions of pressurized fluid flow result in a cycle of alternating centripetal irrigation of the drill bit wherein fluid flows from the periphery of the drill bit into its central bore when said tubular distribution means is in said first position, at least a portion of the fluid flowing upwardly through the central bore of the drill bit being returned to the surface through said second duct, and centrifugal irrigation of the drill bit wherein fluid is caused to flow downwardly through its central bore toward its periphery when said tubular distribution means is caused to move from said first position to said third position and into said second position, with said obturation means closing said lower portion of said tubular distribution means by corresponding successive interruptions and resumptions of pressurized fluid flow, the fluid being returned to the surface along the outside of the drill bit and drill string.

2. A device according to claim 1, wherein said tubular distribution means comprises a piston head sealingly slidable in said axial bore, the underside of which is actuated by said resilient means, said piston head having therein a calibrated aperture through which said pressurized fluid flows, creating a pressure drop across the piston head sufficient to effect a downward displacement of the tubular displacement means from said rest position.

3. A device according to claim 2, wherein said obturation means comprises a stationary rod axially disposed in said axial bore and secured thereto, and having an obturator thereon; wherein said piston head has a central bore having sealing means and said rod extends sealingly through said bore; and wherein said tubular distribution means has a constricted portion below said port, the constricted portion being closed by said obturator when the tubular distribution means is in said first position, and the constricted portion being below said obturator and fully disengaged therefrom when said tubular distribution means is in said second position.

4. A device according to claim 1, wherein said position control means comprises a guide finger and a cam cooperating to limit the axial displacements of said tubular distribution means, one of said finger and said cam being integral with said tubular body and the other of said finger and said cam being integral with said tubular distribution means.

5. A device according to claim 4, wherein said guide finger is solid with said tubular distribution means; and wherein said cam comprises a pair of profiled rings retained by and rotatable at a constant axial level in a sleeve, which sleeve is solid with said tubular body, the upper profiled ring having a saw-toothed profile on its lower edge forming an even number of identical teeth, each tooth having one wall parallel to the ring axis and a second wall inclined to the ring axis, the lower profiled ring having the same number of teeth as the upper ring along its upper edge, each tooth having one wall parallel to the ring axis and one wall inclined to the ring axis, the inclined walls of the teeth on each ring facing in opposite directions from the inclined walls of the teeth on the paired ring, and the lower profiled ring having a plurality of grooves, each groove extending downward from the junction of every second tooth; wherein the teeth of the paired rings are staggered, and the profiled edges thereof cooperate to form said cam within which said guide finger is displaced.

6. A device according to claim 1 and adapted to create a negative pressure in the central bore of the drill bit, wherein said drill bit comprises a Venturi having a nozzle at the inlet thereof communicating with said first duct; wherein the lower extremity of said tubular distribution means is tapered radially inward to form a separator; wherein the lower portion of said tubular distribution means has an orifice in the wall thereof; and wherein said tubular body has a third duct in the wall thereof having an inlet opening into said axial bore at a point above the inlet of said second duct and communicating at its outlet with the exterior of said tubular body at a point below the outlet of said second duct;

wherein in said first position of said tubular distribution means said orifice is aligned with the inlet of said third duct, said separator directs a first portion of the fluid into said second duct and thence to the surface, a second portion of the fluid being directed by said separator through said orifice and recycled to the bit through said third duct; and wherein in said second position said tubular distribution means closes the inlet of said third duct to fluid flow.

7. A device according to claim 1, wherein the outlet of said first duct communicates with the exterior of said tubular body at a point below the outlet of said second duct.

* * * * *